US005299924A

United States Patent [19]

Hirata et al.

[11] Patent Number: 5,299,924

[45] Date of Patent: Apr. 5, 1994

[54] COMPRESSOR HAVING A BLADE SHAPE FOR MINIMAL STRAIN

[75] Inventors: Haruhiko Hirata; Masayuki Okuda, both of Yokohama, Japan

[73] Assignee: Kabushiki Kaisha Toshiba, Kawasaki, Japan

[21] Appl. No.: 27,947

[22] Filed: Mar. 8, 1993

[30] Foreign Application Priority Data

Mar. 9, 1992 [JP] Japan ..... 4-050088
Aug. 31, 1992 [JP] Japan ..... 4-230743

[51] Int. Cl.[5] ..... F01C 21/08
[52] U.S. Cl. ..... 418/220; 418/150
[58] Field of Search ..... 418/220, 150, 152, 159

[56] References Cited

U.S. PATENT DOCUMENTS 4,997,352 3/1991 Fujiwara et al. ..... 418/220
5,026,264 6/1991 Morozumi et al. ..... 418/220
5,062,778 11/1991 Hattori et al. ..... 418/220

FOREIGN PATENT DOCUMENTS 0019683 1/1990 Japan ..... 418/220

*Primary Examiner*—Richard A. Bertsch
*Assistant Examiner*—Charles G. Freay
*Attorney, Agent, or Firm*—Oblon, Spivak, McClelland, Maier & Neustadt

[57] ABSTRACT

A fluid compressor comprises a hollow cylinder closed at the axially opposite ends, a cylindrical turning body disposed within the cylinder and provided with a helical groove formed on the outer peripheral surface of the cylinder, the axis of the turning body being eccentrically displaced from the axis of the cylinder by a given distance, and a blade held and vertically movable in the groove in the direction of the depth of the groove as a compressing element, the compressor drawing operating fluid into the cylinder through a suction port disposed at an end of the cylinder, transferring the drawn-in fluid toward a discharge port disposed at the other end of the cylinder and eventually discharging the fluid through the discharge port by the rotary movement of the turning body as the object of compression, wherein, when the given formula is expressed in terms of the circumferential coordinate and the axial coordinate of the turning body, the values obtained as a result of "differentiation of second order" of the axial coordinate by the peripheral coordinate of the given formula show an approximately continuous distribution.

25 Claims, 11 Drawing Sheets $$\begin{cases} R\cos\Theta = r\cos\theta + e \\ R\sin\Theta = r\sin\theta \end{cases}$$

COMPRESSOR HAVING A BLADE SHAPE FOR MINIMAL STRAIN

BACKGROUND OF THE INVENTION

1. Field of the Invention

This invention relates to a compressor for compressing gas that operates as a fluid cooling medium in a refrigerating cycle machine and, more particularly, it relates to a liquid compressor comprising a helical blade.

2. Description of the Related Art

Various types of compressors are known including the "reciprocal type" and the "rotary type". Compressors of these known types, however, normally have a very complicated configuration including a drive unit and a compression unit, to which the turning effort of the drive unit is transmitted by means of one or more than one crank shafts of the drive unit, making the overall number of components and hence the manufacturing cost of the compressor considerable. Additionally, the rotary unit of such compressors is frequently off balanced and hence generates large noises.

In an attempt to solve these problems, fluid compressors comprising a helical blade have recently been proposed.

FIG. 16 of the accompanying drawings illustrates the compression unit of a known "helical blade type" fluid compressor. It comprises a cylinder 101, a turning body 102 which is slightly eccentrically located within and rotates relative to the cylinder 101 and a helical blade 104 fitted into and slidingly and radially movable in a helical groove 103 formed on the outer peripheral surface of the turning body 102.

The blade 104 slidingly and radially shifts its position in the groove 103 as the turning body 102 rotates relative to the cylinder 101. The opposites ends of the cylinder 101 and those of the turning body 102 are "freely rotatably" held by respective bearings 105 and 106. The bearings are respectively provided with a suction port 107 and a discharge port 108. Starting from the suction port 107, the pitch of the helix is gradually and progressively increases toward the discharge port 108 as a function of the distance from the suction port 107.

With such an arrangement, starting again from the suction port 107, the volumes of the spaces defined by the cylinder 101, the turning body 102 and the blade 104 gradually or progressively decrease toward the discharge port 108 as a function of the distance from the suction port 107. Thus, the operating fluid taken up by the unit through the suction port 107 is gradually compressed as it advances toward the discharge port 108 by the rotary movement of the turning body 102 until it is released from the discharge port 108.

With a fluid compressor having a compression unit having a configuration as described above, the "compression performance" of the unit are determined by the form and arrangement and of the groove 103 disposed on the peripheral surface of the turning body 102.

More specifically, the "compression ratio" of the fluid is determined by the ratio of the volume of the space closest to the suction port 107 to that of the space closest to the discharge port 108 regardless of the volumes of all the intermediate spaces defined by the cylinder 101, the turning body 102 and the blade 104. Therefore, in order for the compression ration to have a large value, it is necessary to make the volume of the space closest to the suction port 107 as large as possible relative to that of the space closest to the discharge port 10.

To meet the above requirement, conventional compressors typically have a blade holding groove 103 realized in a form as defined by the line graph of FIG. 17, (showing the relationship between the axial distance from the suction port 107 and the circumferential angle of the groove). In FIG. 17, the abscissa represents the circumferential angle $\theta$ of the groove 103 and the ordinate represents the distance Z from the suction port 107 of the turning body 102. The form of the groove consists of curve f and curve g. More specifically, the curve f is located closer to and convex toward the suction port 107 whereas the curve g is located closer to and convex toward the discharge port 108, the two different curves being linked at junction h. The fact that the suction port side curve f is convex toward the suction port 107 allows large spaces to be defined by the cylinder 101, the turning body 102 and the blade 104 near the suction port 107, contributing to the realization of a relatively large compression ratio.

Meanwhile, as the blade 104 goes in and out from (or, in other words, moves slidingly and radially in) the groove 103 of the turning body 102, groove is forced to deform the blade and consequently generates strain and stress inside of the blade. The generated strain and stress are distributed on the circumference direction of the blade 104. The inventors of the present invention conducted a mathematical analysis in a manner as described below as showing in FIGS. 21A to 21D to determine how strain and stress are generated in the blade as the blade is deformed in the helical groove of the turning body. If the blade initially has a helical form identical with that of the blade holding groove, no deformation can occur on the blade so long as the blade and the groove are coaxially arranged but the blade will be deformed to produce strain and stress in it once it is eccentrically disposed relative to the groove because the former is forced to conform to the shape of the latter. Assuming that there are a cylindrical coordinate system (R, Θ, Z) with the Z-axis superposed on the center axis of the blade and another cylindrical coordinate system (r, Θ, z) with the z-axis superposed on the center axis of the groove of the turning body and that the eccentrically of the two axis is expressed by e, a coordinate transformation can be carried out for either of the two coordinate systems by using the following equations if any eccentrically exists between the two systems.

$$R\cos\Theta = r\cos\theta + e \ldots \quad (2\text{-}1)$$

$$R\sin\Theta = r\sin\theta \quad \ldots (2\text{-}2)$$

Assuming that the Z-coordinate of the blade has an initial value of $Z_B$ before the blade is deformed and that the z-coordinate of the groove of the turning body has a value of $z_p$, the displacement of the blade in the Z-direction, or $\delta Z$, is expressed by the following equation.

$$\begin{aligned} \delta Z &= z_P(\theta) - X_B(\Theta) \\ &= z_P[\mathrm{Tan}^{-1}\{R\sin\Theta/(R\cos\Theta - e)\}] - Z_B(\Theta) \end{aligned} \quad (2\text{-}3)$$

If the gradient of the groove is $\gamma$, the displacement of the blade in the direction perpendicular to its outer or upper surface, or $\delta Z_B$, is expressed as follows.

$$\delta Z_B = \delta Z \cos\gamma \quad \ldots (2\text{-}4)$$

If the displacement of the inner periphery of the blade in the direction perpendicular to its outer or upper surface is $\delta Z_{Bi}$ and the displacement of the outer periphery of the groove of the turning body in the direction perpendicular to its outer or upper surface is $\delta Z_{BO}$, they are respectively expressed by the following formulas.

$$\delta Z_{Bi} = \{z_p[Tan^{-1}\{R_i \sin\Theta/(R_i \cos\Theta - e)\}] - Z_B(\Theta)\} \cos\gamma_o \quad \ldots (2\text{-}5)$$

$$\delta Z_{B0} = \{z_p[Tan^{-1}\{R|_{r=ro} \sin\Theta/(R|r=ro \cos\Theta - e)\}] - Z_B(\Theta)\} \cos\gamma_o \quad \ldots (2\text{-}6)$$

where Ri is the inner diameter of the blade, ro is the outer diameter of the groove and $R|_{r=ro}$ is the radial coordinate of the outer periphery of the groove in the cylindrical coordinate system of the blade when the blade is eccentric relative to the groove and expressed by $$R|_{r=ro} = e \cdot \cos\Theta + \sqrt{r_o^2 - e^2(1 - \cos^2\Theta)} \quad (2\text{-}7)$$

If the blade is assumed as a circumferentially spread "straight beam", the bending surface strain $\epsilon$ of the blade is a function of the radius of curvature of beam deformation and expressed by the following formula.

$$\epsilon == \pm H/2\rho \quad \ldots (2\text{-}8)$$

where H is the thickness of the blade and $\rho$ is a value expressed by the equation below, because the blade tangential direction coordinate T is expressed as $T = R\Theta/\cos\gamma$.

$$1/\rho = \partial^2 \partial Z_B/\partial T^2 \quad \ldots (2\text{-}10)$$

If $\delta Z_B$, $\gamma$ and R are discretely determined with an interval of $\delta\Theta$, the value of $\rho$ can be obtained by using the discrete values of these three points. Namely, $$a = [(2R_2\delta\Theta/\cos\gamma_{l-3})^2 + (\delta Z_{B1} - \delta Z_{B3})^2]^{\frac{1}{2}} \quad \ldots (2\text{-}11)$$

$$A = Tan^{-1}[(R_2\delta\Theta/\cos\gamma_{1-3})/(\delta Z_{B2} - \delta Z_{B1})] + \mathrm{Tan}^{-1}[R_2\delta\Theta/\cos\gamma_{1-3})/(\delta Z_{B2} - \delta Z_{B3})] \quad \ldots (2\text{-}12)$$

$$\rho_2 = a/2\sin A \quad \ldots (2\text{-}13)$$

Assuming that the initial gradient of the blade is $\phi(R,\Theta)$ and the gradient angle of the groove is $\phi(r, \theta)$, then the torsion displacement angle $\delta\Phi$ of the blade at its radial axis is expressed by the equation below.

$$\delta\Phi = \phi - \Phi \quad \ldots (2\text{-}14)$$

Similarly, the torsion displacement angle $\delta\Phi_1$ of the blade at its inner periphery and the torsion displacement angle $\delta\Phi_0$ of the blade at its outer periphery are respectively expressed by the following equations.

$$\delta\Phi_i \phi(r|_{R=Ri}, Tan^{-1}\{R_i \sin\Theta/(R_i \cos\Theta - e)\}) - \phi(R_i, \Theta) \quad \ldots (2\text{-}15)$$

$$\delta\Phi_o = \phi(r_o, Tan^{-1}\{R|_{r=ro} \sin\Theta/(R|_{r=ro} \cos\Theta - e)\}) - \phi(R|r=ro, \Theta) \quad \ldots (2\text{-}16)$$

where $$r|_{R=Ri} = \sqrt{R_i^2 - 2eR_i \cos\Theta + e^2} \quad (2\text{-}17)$$

The torsion angle $\omega_{NT}$ per unit length of the blade at its radial axis can be obtained by using the torsion displacement angle of the inner periphery of the blade, that of the outer periphery of the blade and the radial length $\Delta R$ of the engaging area of the blade and groove.

$$NT = (\delta\Phi_o - \delta\Phi_i)/\Delta R \quad \ldots (2\text{-}18)$$

where $\Delta R = R|_{r-ro-Ri}$. The shear strain of the blade surface generated by the torsion, or $\gamma_{NT}$, can be obtained from $\omega_{NT}$ above.

$$\gamma NT = \pm H\omega NT/^2 \quad \ldots (2\text{-}19)$$

If Z, R, $\delta Z$ are discretely determined with an interval of $\delta\Theta$, the value of $\delta\Phi$ can be obtained by using the discrete values of these two points. Namely, $$\delta\Phi_1 = \mathrm{Tan}^{-1}[\{(Z_2 + \delta Z_2) - (Z_1 + \delta Z_1)\}/R_1\delta\Theta] - \mathrm{Tan}^{1}((Z_2 - Z_1)/R_1\delta\Theta\} \quad \ldots (2\text{-}20)$$

According to a computation, a compressor of a known type provided with a groove defined by the line graph of FIG. 17 shows a circumferential direction distribution of bending strain as illustrated by the graph of FIG. 18.

It is apparent from FIG. 18 that the strain of the blade 104 reaches a maximum at the junction h of FIG. 17 where the two different component curves of the groove meet. Because of the very large strain to which the blade 104 is periodically subjected at the junction h of the two component curves when the turning body 102 is rotated, blades of the type under consideration are frequently damaged and broken at the junction h.

The forced deformation of the blade 104 also gives rise to a strain in it distributed radially and in the direction perpendicular to the principal surfaces of the blade 104, let alone a concentrated distribution of strain on the peripheries. According to a computation carried out by the inventors of the present invention, the bending strain generated by deformation of the helical blade of a conventional compression unit having a turning body with a groove defined by the line graph of FIG. 17 shows circumferential and radial distributions and a distribution in the direction perpendicular to the principal surfaces of the blade as illustrated respectively in FIGS. 18, 19 and 20.

It is seen from FIGS. 19 and 20 that the strain in the blade 104 shows a maximum also at a point on the inner periphery of the blade 104 that corresponds to the junction h of the two component curves and at points on the principal surfaces of the blade 104 corresponding to the junction h.

As described above, since conventional compressors are provided with a blade holding groove on the turning body having a form consisted of two component curves with a view to giving it a high compression ratio, they can periodically produce a large strain in the blade at locations corresponding to the junction of the two component curves when the burning body is rotated. Such a strain can eventually damage and break the blade.

SUMMARY OF THE INVENTION

It is therefore an object of the present invention to provide a compressor having a large compression ratio and substantially free from damage and breakage of the blade.

The above object is achieved by providing a compressor according to any of the four aspects of the invention, which will be described below.

According to a first aspect of the invention, there is provided a fluid compressor comprising a hollow cylinder closed at the axially opposite ends, a cylindrical turning body disposed within said cylinder with a given eccentricity and provided with a helical groove formed on its outer peripheral surface and a helical blade radially and slidingly movable in said groove of the turning body as a compressing element in order to gradually transfer the operating fluid drawn in through a suction side toward a discharge side of the cylinder and compress said operating fluid, characterized in that said helical groove is realized in a form that satisfies a single formula defining the relationship between the circumferential coordinate and the center axial coordinate of the turning body.

According to a second aspect of the invention, there is provided a fluid compressor having a configuration same as that of a compressor according to the first aspect of the invention, characterized in that said helical groove is realized in a form where the result of "differentiation of second order (i.e. second order derivative of Z by $\theta$)" of the center axial coordinate by the circumferential coordinate in the above formula defining the relationship between the circumferential coordinate and the center axial coordinate of the turning body shows a substantially continuous distribution.

According to a third aspect of the invention, there is provided a fluid compressor having a configuration same as that of a compressor according to the first aspect of the invention, characterized in that said helical groove is realized in a form that is expressed by a plurality of formulas linked together to define the relationship between the circumferential coordinate $\theta$ and the axial coordinate Z of the turning body, one of said formulas being of a linear relation of $\theta$ and Z and portions of the helical groove linked to the respective opposite ends of the portion expressed by said linear relation are expressed by respective formulas having a gradient same as that of said linear relation at the junction.

According to a fourth aspect of the invention, there is provided a fluid compressor having a configuration same as that of a compressor according to the first aspect of the invention, characterized in that angular portions on the inner periphery of said helical blade are beveled i.e. chamfering.

ADVANTAGES

A fluid compressor according to the first aspect of the invention can reduce the level of maximum strain in the blade by using a blade holding groove having a form which is expressed by a single formula.

A fluid compressor according to the second aspect of the invention can reduce the strain generated in the blade by using a blade holding groove having a form where the result of an operation of differentiation of second order of the axial coordinate by the circumferential coordinate in at least part of the above formula defining the relationship between the circumferential coordinate and the axial coordinate of the turning body shows a substantially continuous distribution.

A fluid compressor according to the third aspect of the invention can reduce the strain generated in the blade by using a blade holding groove having a form that consists of a plurality of curved and linear portions, the effect of reducing the strain is particularly remarkable at the junctions of the curved and linear portions.

A fluid compressor according to the fourth aspect of the invention can reduce the strain generated in the blade by using a helical blade whose angular portions on the inner periphery are beveled, the effect of reducing the strain is particularly remarkable on those areas of the inner peripheral surface where the curved lines are linked.

Thus, a fluid compressor according to any of the above aspects of the present invention has a large compression ratio and, at the same time, is substantially free from damage and breakage of the blade.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 3:
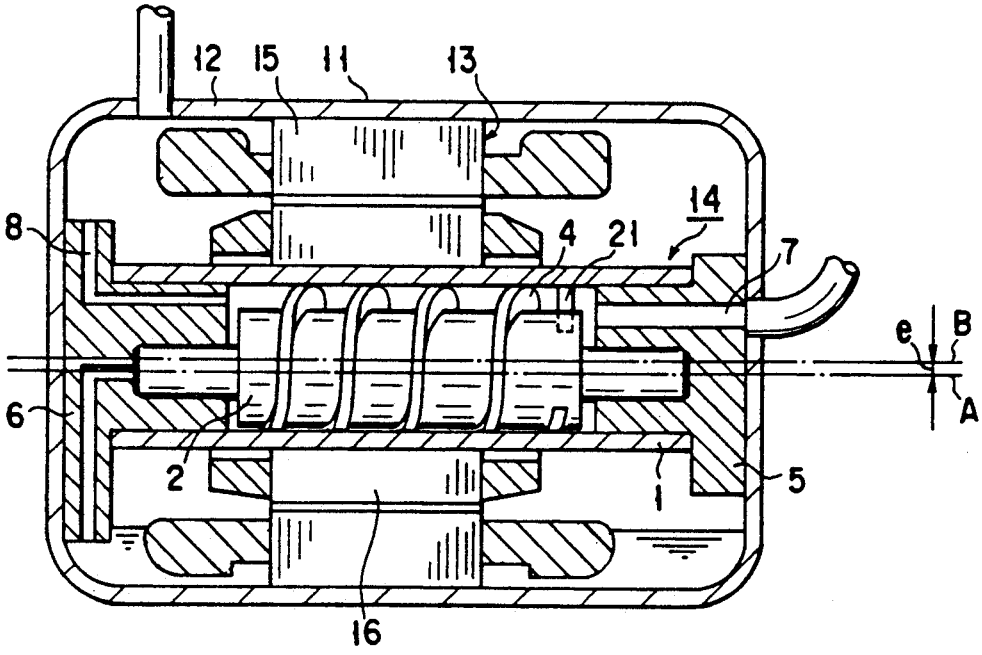
FIG. 3 is a sectional view of a fluid compressor according to the invention, schematically illustrating its overall configuration.

Firstly, the overall configuration of a fluid compressor according to the invention will be briefly described by referring to FIG. 3.

The illustrated fluid compressor is typically used for a refrigerating cycle machine and is a closed type compressor that draws in cooling gas and compresses and discharges it on a cyclic bases.

The main body 11 of the compressor comprises an electric motor unit 13 and a compression unit 14 contained in a sealed case 12.

The electric motor unit 13 comprises an annular stator 15 rigidly secured to the inner lateral wall of the sealed case 12 and an annular rotor 16 disposed inside the stator 15.

The compressor unit 14 comprises a cylinder 1, said annular rotor 16 being coaxially arranged around the outer peripheral surface of the cylinder 1.

The cylinder 1 is rotatably held at its opposite ends respectively by main bearing 5 disposed at the suction side of the compressor and rigidly fitted to the inner surface of the sealed case 12 by tie bolts or similar appropriate means and by sub bearing 6 disposed at the discharge side of the compressor and firmly fitted to the inner surface of the sealed case 12 also by tie bolts or similar appropriate means, the opposite ends of the cylinder 1 being airtightly sealed by the main and sub bearings 5 and 6 respectively.

The cylinder 1 contains in its hollow inside a cylindrical turning body 2 with its axis disposed in parallel with that of the cylinder 1 and eccentrically separated therefrom by a given distance e such that the outer peripheral wall of turning body 2 is partly and axially in contact with the inner peripheral wall of the cylinder. The turning body 2 operates as a piston.

The turning body 2 is provided at an end with an engagement groove (not shown) extending from the outer periphery toward the center axis of the turning body 2 and a drive pin 21 projecting from the inner peripheral wall of the cylinder 1 is radially and retractably held in engagement with the groove in such a manner that a turning force transmission mechanism is produced by the engagement groove and the drive pin 21.

FIRST EMBODIMENT

Figure 2:
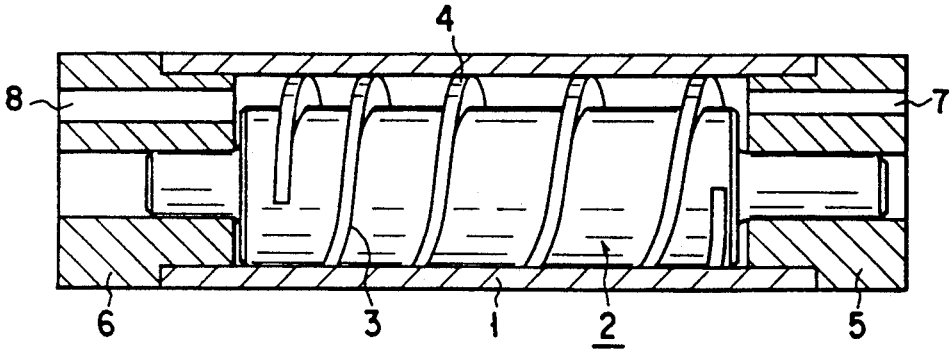
FIG. 2 is a partial sectional view of a fluid compressor according to the invention, illustrating its principal areas.

FIG. 2 illustrates principal areas of a fluid compressor according to the invention, including a cylinder 1, a turning body 2 disposed eccentrically within the cylinder 2 and capable of rotating relative to the cylinder 1 and a helical blade 4 made of fluororesin material inserted into a helical groove 3 formed on the outer peripheral surface of the turning body 2.

As the turning body 4 rotates relative to the cylinder 1, the blade 4 slidingly and vertically move in the groove so that the blade 4 may be located deep or shallow in the groove depending on the position of the turning body 2 relative to the cylinder 1. The opposite ends of the cylinder 1 and those of the turning body 2 are rotatably held by respective bearings 5 and 6, which bearings 5 and 6 respectively comprises a suction port 7 and a discharge port 8 for operating fluid. Thus, the operating fluid drawn into the cylinder through the suction port 7 is gradually compressed while it is transferred toward the discharge side in the cylinder by the rotary movement of the turning body 2 until it is discharged through the discharge port 8.

Figure 1:
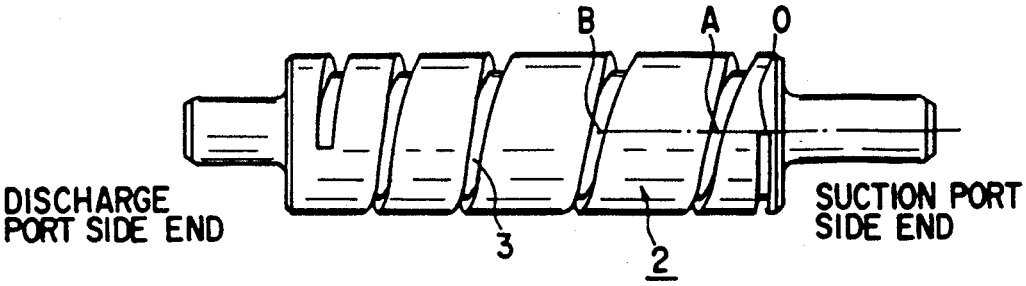
FIG. 1 is a partial sectional view of a fluid compressor according to the invention, illustrating the principal areas of the turning body and the groove.

The primary feature of the first embodiment that embodies the first aspect of the invention lies in the form of the groove 3. FIG. 1 schematically shows the turning body 2 provided with a groove 3 and FIG. 4 is a graphic representation of the form of the groove 3 of the embodiment.

In the following description, the groove 3 starts from position 0 located next to the suction port 7 and reaches position A when it spirally turns 360° on the outer peripheral surface of the turning body 2 and then position B when it turns 720° on the outer surface of the turning body 2.

Figure 4:
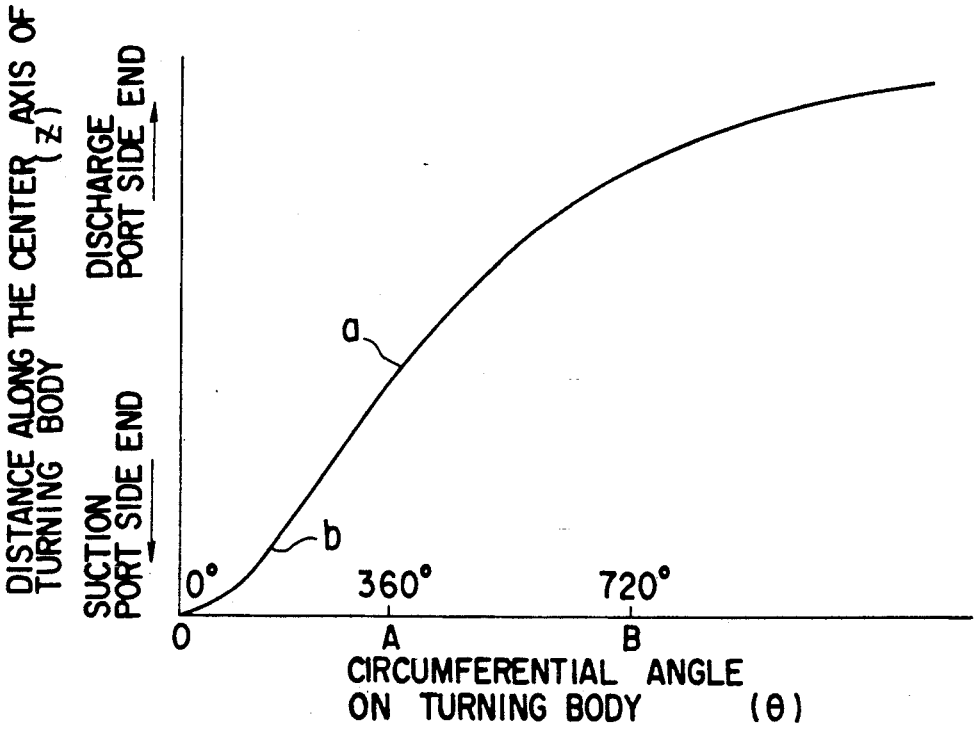
FIG. 4 shows a graph representing the form of the groove of an embodiment of the first aspect of the invention.

FIG. 4 shows a curved line that defines the form of the groove 3 of the embodiment when the abscissa represents the peripheral angle $\theta$ of the turning body 2 and the ordinate represents the axial distance Z from the end of the turning body 2 located close to suction port 7 and is obtained by spreading the outer peripheral surface of the turning body 2 of the embodiment.

The groove 3 has the form of a curved line a which is convex toward the suction port 7 on the suction port side and conversely convex toward the discharge port 8 on the discharge port side. The curved line a is expressed by formula (1-1) below.

$$Z=A\theta^{D}/(B\theta^{E}+C) \quad \ldots (1\text{-}1)$$

where A, B, C, D and E are constants.

Figure 5:
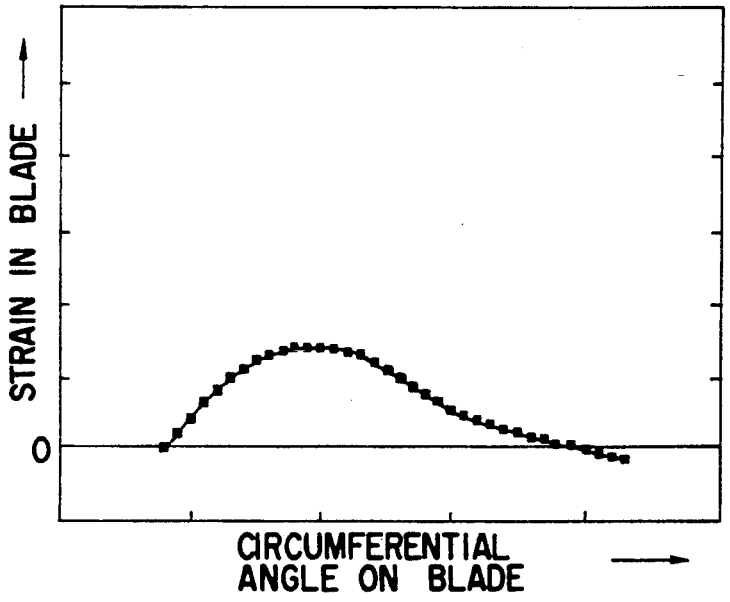
FIG. 5 shows a graph representing the strain generated in the blade of the embodiment of FIG. 4.

According to a computation carried out by the inventors of the present invention, the bending strain generated in the blade 4 when it is forced to deform by the rotation of the turning body 2 having a groove the form of which is as defined above shows a peripheral distribution as graphically illustrated in FIG. 5. Note that the ordinate of the graph of FIG. 5 representing the magnitude of bending strain in the blade has a unit same as that of the ordinate of the graph of FIG. 18 for a conventional blade. And also the computation is carried out by the same process described above.

Figure 18:
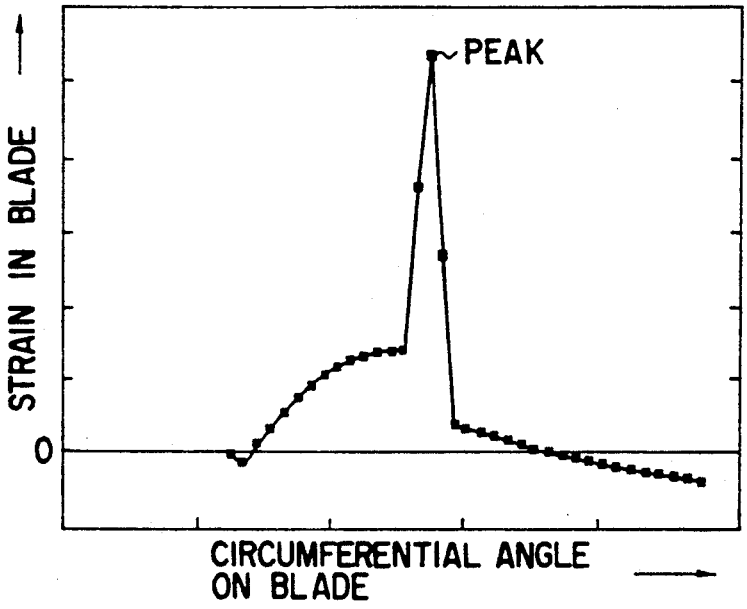
(PRIOR ART) FIG. 18
FIG. 18 shows a graph representing a distribution of strain in the blade of a conventional fluid compressor.
Figure 19:
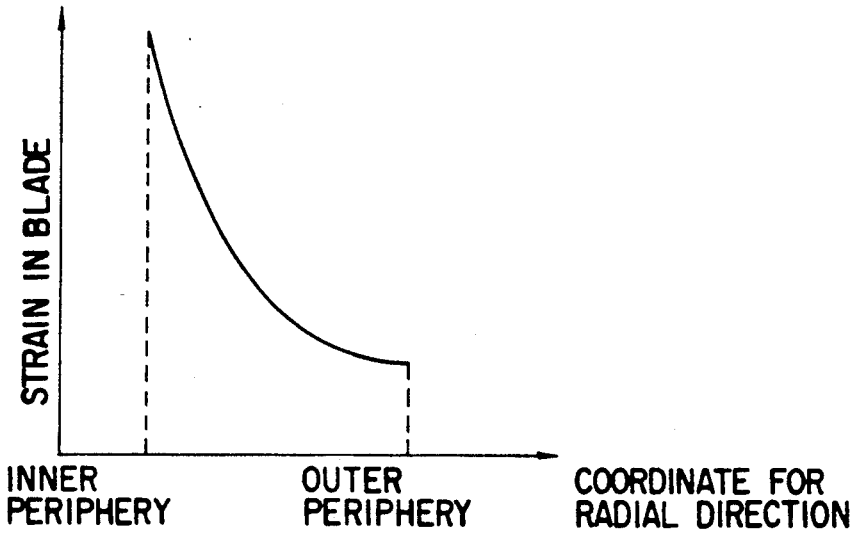
(PRIOR ART) FIG. 19
FIG. 19 shows a graph also representing the distribution of strain of FIG. 18 but viewed from a different angle.
Figure 20:
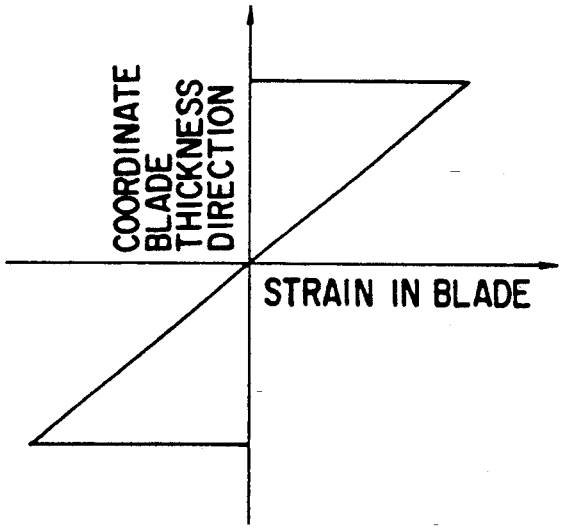
(PRIOR ART) FIG. 20
FIG. 20 shows a graph also representing the distribution of strain of FIG. 18 but viewed from still another different angle.
Figure 21A:
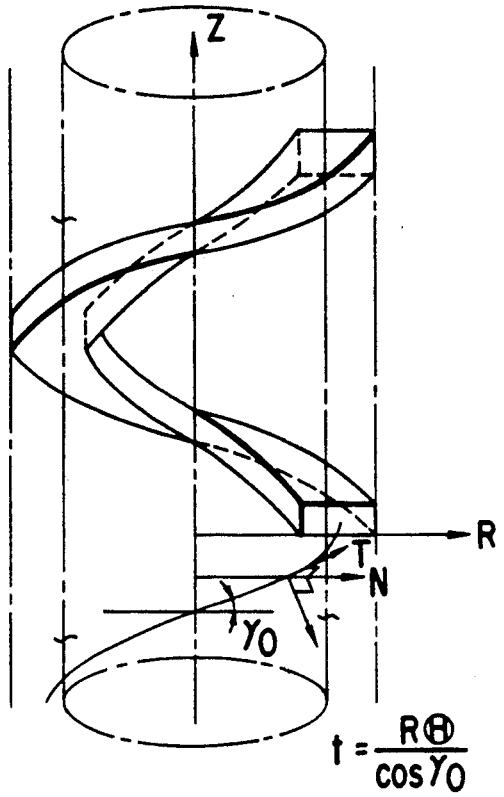
FIG. 21A (PRIOR ART)
FIG. 21A to FIG. 21D show the blade and the groove of the turning body of a conventional fluid compressor.
Figure 21B:
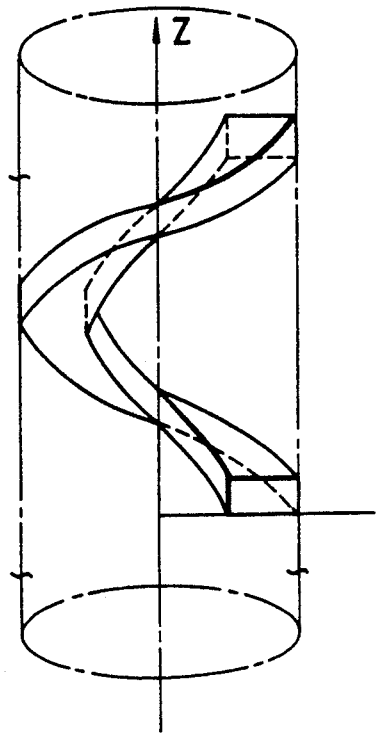
FIG. 21B (PRIOR ART)
Figure 21C:
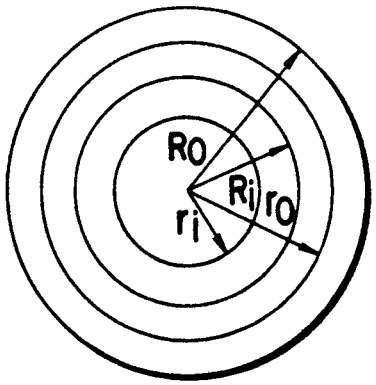
FIG. 21C (PRIOR ART)
Figure 21D:
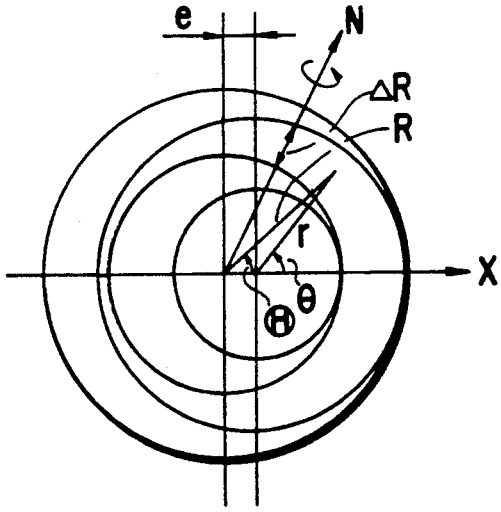
FIG. 21D (PRIOR ART)

It is apparent by comparing FIGS. 5 and 18 that the strain periodically generated in the blade 4 of the embodiment by the rotation of the turning body 2 is by far smaller than that of the blade 4 of a conventional compressor illustrated in FIG. 18. Thus, it will be understood that a blade having a configuration as defined by the line graph of FIG. 4 is substantially free from damage and eventual breakage of the blade due to strain.

Since the form of the groove 3 defined by the line graph of FIG. 4 has part b which is located close to and convex toward the suction port 7, the blade 4 provides a large space (i.e. the largest of all the spaces) at a position adjacent to the suction port 7, allowing a large compression ratio which is by far greater than that of a conventional blade.

While the groove 3 of the above embodiment is defined by the formula (1-1) above, it may alternatively be defined by either formula (1-2) or (1-3) below.

$$Z=F\,exp(G\theta^{H}) \quad \ldots (1\text{-}2)$$

$$Z=I/(J+exp(K\theta^{L})) \quad \ldots (1\text{-}3)$$

where F, G, H, I, J, L and L are constants.

Although only three formulas are mentioned above as those that can be used to define the form of the groove 3, it may be understood that the possible formulas are not limited to the above and many others may alternatively be used to define the form of the groove for the purpose of the first aspect of the invention.

SECOND EMBODIMENT

Since the principal components of the second embodiment of the invention that embodies the second aspect of the invention, including the turning body 2 and the groove 3, are similar to those illustrated in FIG. 2, they are indicated and referred to by the identical reference symbols and will not be described any further.

Figure 6:
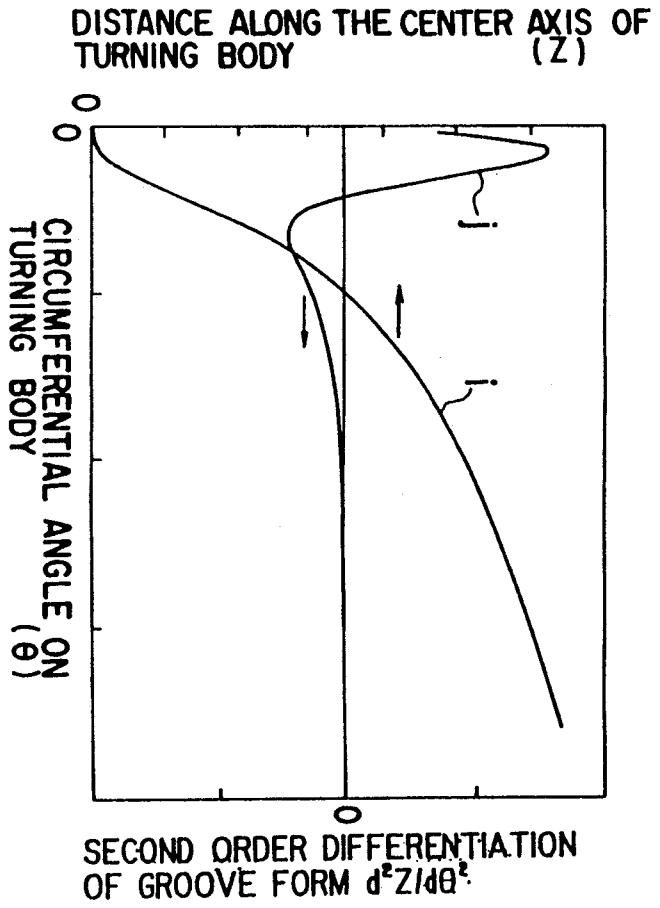
FIG. 6 shows graphs respectively representing the form of the groove of an embodiment of the second aspect of the invention and the result of an operation of differentiation of second order of the form of the groove.

The primary feature of this second embodiment also lies in the form of the groove 3, which is defined by the line graphs of FIG. 6. FIG. 6 shows curved line i that defines the form of the groove 3 of the second embodiment when the abscissa represents the peripheral angle $\theta$ of the turning body 2 and the ordinate represents the axial distance Z from the end of the turning body 2 located close to suction port 7 and is obtained by spreading the outer peripheral surface of the turning body 2 of the embodiment as well as curved line j showing the result of an operation of "differentiation of second order" of the axial length Z of the groove by the circumferential angle $\theta$ in the formula defining the form of the groove of the second embodiment. As seen from FIG. 6, the second embodiment is featured by the fact that the curved line j representing the differentiation of second order of the groove does not have any discontinuity (unlike part u of line graph k in FIG. 7).

Figure 7:
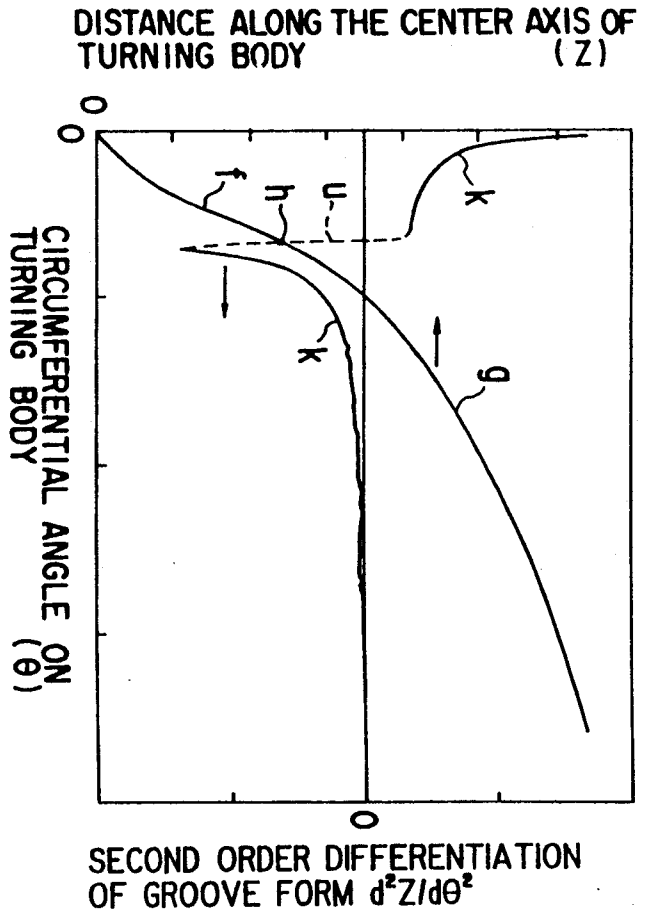
(PRIOR ART) FIG. 7
FIG. 7 shows graphs similar to those of FIG. 6 but respectively representing the form of the groove of a conventional fluid compressor and the result of differentiation of second order of the form of the groove.

For convenience of comparison, FIG. 7 shows line graphs for the groove of a conventional compressor that respectively correspond to those of FIG. 6. In FIG. 7, curved lines f, g are linked at junction h and collectively define the form of the groove, whereas line graph k represents the result of an operation of "differentiation of second order" of the form of the groove and has a point of discontinuity at u.

Figure 8:
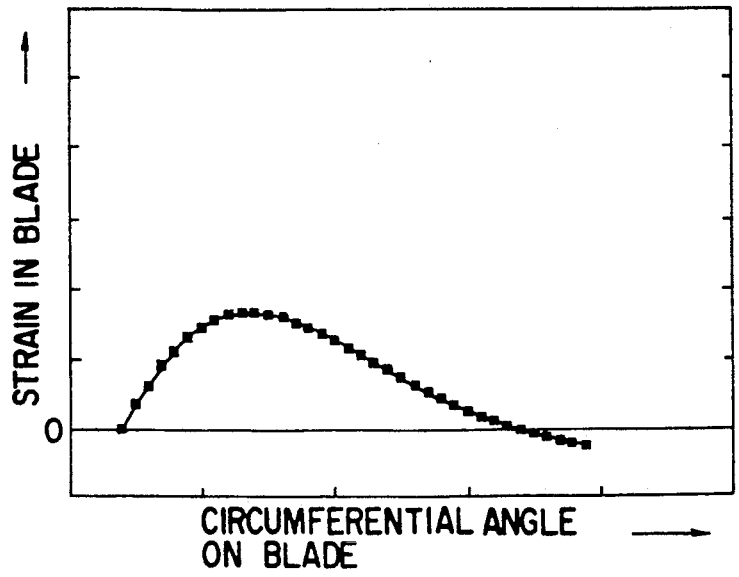
FIG. 8 shows a graph representing the distribution of strain on the blade of the embodiment of FIG. 6.

According to a computation described above carried out by the inventors of the invention, the bending strain produced in the blade 4 when it is forcedly deformed by the rotation of the turning body 2 will show a circumferential distribution as illustrated in FIG. 8. As already mentioned, FIG. 18 shows the circumferential distribution of bending strain of the blade of a conventional compressor having a groove on the turning body as defined by the lines f and g in FIG. 7. As seen, the bending strain of the blade of the conventional compressor rises enormously at the junction of the two component curved lines. Note that the ordinate of FIG. 8 has a unit same as that of FIG. 18.

It is apparent by comparing FIGS. 8 and 18 that the strain produced in the blade of the above described second embodiment in operation is by far lower than the strain in the blade of a conventional compressor and hence the blade of the embodiment is substantially free from breakage.

Figure 9:
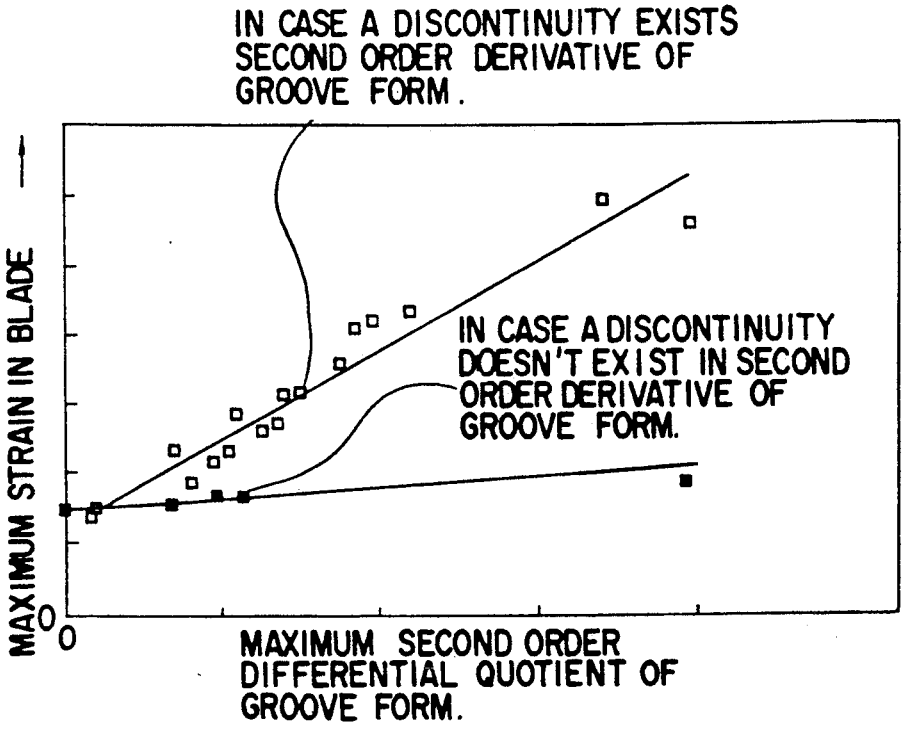
FIG. 9 shows graphs respectively representing the relationship between the values obtained by differentiating to the second order of the form of the groove and the strain values of the blade of the embodiment of FIG. 6.

The inventors of the present invention have proved by computation that the differential quotient of second order of the form of the groove is clearly interrelated with the strain generated in the blade. FIG. 9 shows the relationship between the strain of the blade and the differential quotient of second order of the form of the groove.

More specifically, the graph of FIG. 9 shows solid lines obtained by plotting the differential quotient of second order relative to the strain in the blade for various blades having different forms, the abscissa and ordinate respectively representing the maximum (i.e. peak) value of the quadractic differentiation carried out the blade form and the strain of the blade produced at the corresponding spot. As apparent from the graph, the differential quotient of second order and the strain of the blade have a "positive interrelationship (i.e. positive correlation)". It has also been proved that the cases where the differentiation of second order has a point of discontinuity and those where it has no discontinuity show clearly different tendencies.

In the cases where the differentiation of second order has no discontinuity, the change in the bending strain is less sensitive (e.g. low sensitivity) to changes in the value of differentiation of second order of the form of the groove (i.e., the rate of change is small) and, at the same time, the bending strain remains below a remarkably reduced level.

Thus, by forming the groove 3 in such a way that the differentiation of second order of the form of the groove 3 does not show any point of discontinuity, the strain produced in the blade 4 will be remarkably reduced and consequently the blade will be securely protected against breakage.

While the form of the groove of the above described second embodiment may satisfy one of the formulas (1-1) through (1-3), it may be different from that of the groove of the first embodiment described earlier.

It will also be seen that the form of groove defined by the curved line i in FIG. 6 is convex toward the suction port 7 at the suction side, it is capable of drawing in a relatively large volume of fluid at a time and hence showing a large compression ratio.

THIRD EMBODIMENT

Since the principal components of the third embodiment of the invention that embodies the third aspect of the invention, including the turning body 2 and the groove 3, are similar to those illustrated in FIG. 2, they are indicated and referred to by the identical reference symbols and will not be described any further.

Figure 10:
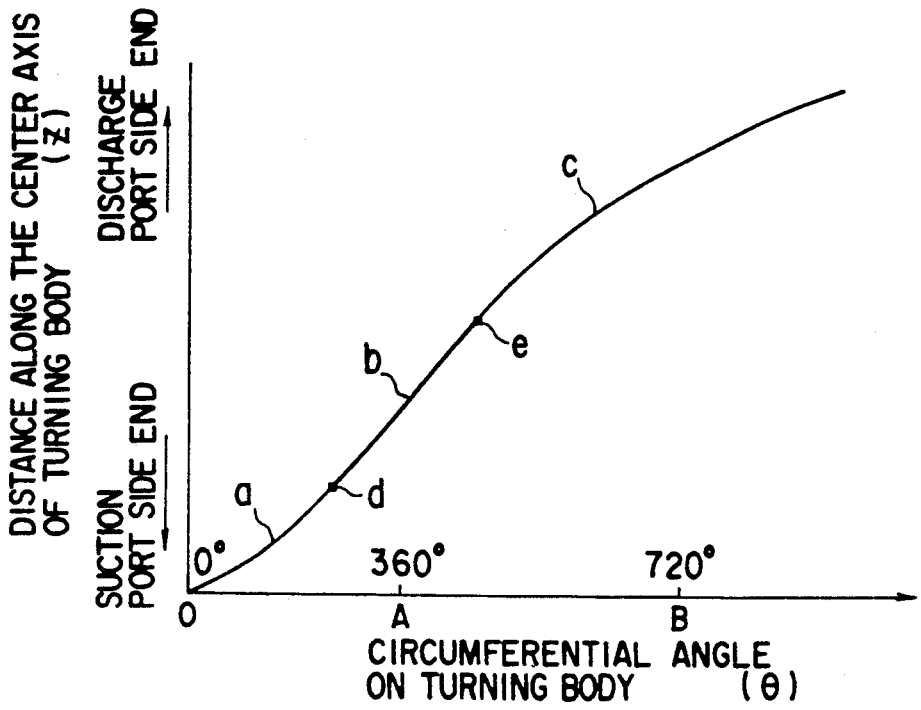
FIG. 10 shows a graph representing the form of the groove of an embodiment of the third aspect of the invention.

The primary feature of this third embodiment also lies in the form of the groove 3, which is slightly different from those of the grooves 3 of the first and second embodiments. The form of the groove 3 produced on the turning body 2 of this third embodiment is defined by the curved graph of FIG. 10. As in the case of FIG. 4 illustrating a curved line that defines the form of the groove 3 of the first embodiment, the abscissa of the graph represents the peripheral angle, or $\theta$, of the turning body 2 and the ordinate represents the axial distance, or Z, from the end of the turning body 2 close to the suction port 7. In other words, the curved line is obtained by spreading the turning body 2. As shown in FIG. 10, the line graph comprises a curved line a which is convex toward and located close to the suction port 7, a straight line b and another curved line c which is convex toward and located close to the discharge port 8 of the cylinder of the embodiment, the curved lines a and c having an angle of inclination identical with that of the straight line b at the respective junctions d and e where they are respectively linked with the straight line b.

The curved lines a and c are rotationally symmetrical relative to the straight line b and these three lines a, b and c are expressed by the following respective formulas (2-1) through (2-3).

$$Z=-A(B-\theta)^C+D \quad \ldots (2\text{-}1)$$

$$Z=E(B-\theta)+F \quad \ldots (2\text{-}2)$$

$$Z=A(\theta-B)^C+G \quad \ldots (2\text{-}3)$$

where A, B, C, D, E, F and G are constants.

Figure 11:
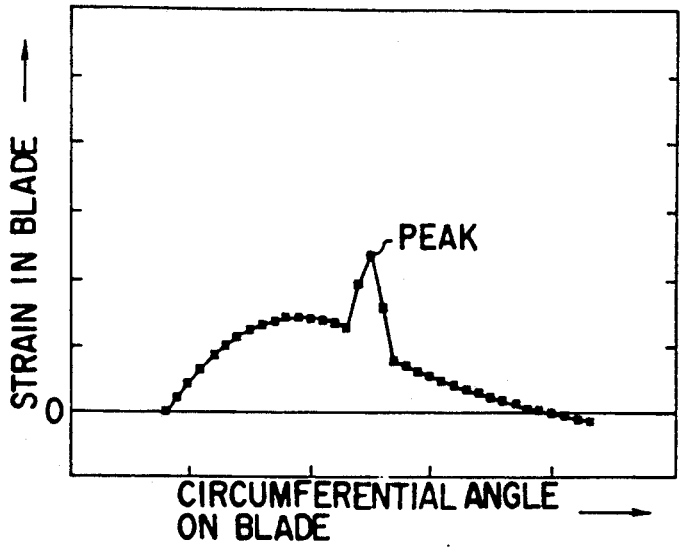
FIG. 11 shows a graph representing the distribution of strain in the blade of the embodiment of FIG. 10.

According to a computation carried out by the inventors of the present invention, the bending strain generated in the blade 4 when it is forced to deform by the rotation of the turning body 2 having a groove the form of which is as defined above shows a peripheral distribution as graphically illustrated in FIG. 11. Note that the ordinate of the graph of FIG. 11 representing the magnitude of bending strain the blade has a unit same as those of FIG. 5 showing the first embodiment and FIG. 18 showing the form of a conventional blade. Also note that the strain in the blade 4 shows peaks at spots corresponding to the respective junctions d and e of curved lines and a straight line of FIG. 10.

Figure 17:
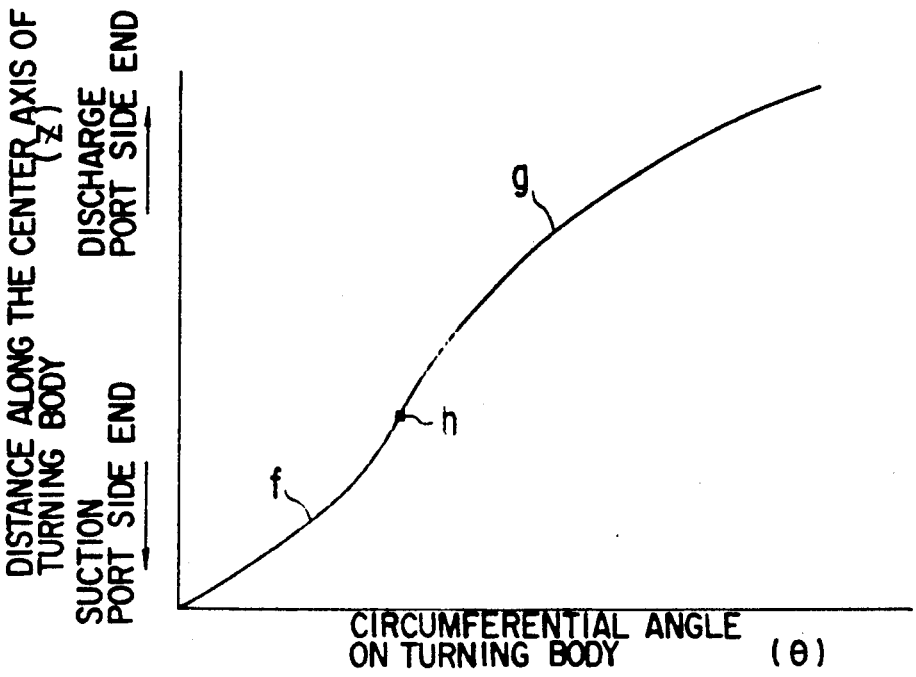
(PRIOR ART) FIG. 17
FIG. 17 shows a graph representing the form of the groove of a conventional fluid compressor.

Therefore, it is apparent by comparing FIGS. 11 and 18 that the strain periodically generated at those spots of the blade 4 of the embodiment that respectively correspond to the junctions d and e of curved lines and a straight line of FIG. 10 is by far smaller than that of the spot of the blade 4 of a conventional compressor corresponding to the junction h of two curves in FIG. 17.

It will be understood that a blade 4 engaged with a groove having a configuration as described above is substantially free from breakage unlike the blade of a conventional compressor having a groove realized by connecting two curved lines that is apt to be damaged at a spot corresponding to the junction of the curved lines of the groove as described earlier. While the strain in the blade shows peaks at a pair of spots corresponding to the junctions d and e of the graph of FIG. 10, the peak values are made equal to each other and suppressed in a coordinated manner by arranging the curved lines a and c rotationally symmetric relative to the straight line b of FIG. 10.

Since the form of the groove 3 defined by the line graph of FIG. 10 has part a which is located close to and convex toward the suction port 7, the blade 4 provides a large space at a position adjacent to the suction port 7, allowing a large compression ratio which is by far greater than that of a conventional blade.

While the groove 3 of the third embodiment is defined by means of one of the exponential functions (2-1) through (2-3) in the above description, it may alternatively be defined by means of an exponential function other than those listed above, a trigonometric function, an inverse trigonometric function, a hyperbolic function, an inverse hyperbolic function, a cylindrical function or any other appropriate function to obtain similar effects.

Still alternatively, one or more than one curves and/or straight lines may be connected to the suction side end of the curved line a which is convex toward the suction port 7 and/or the curved line b which is convex toward the discharge port 8 of the compressor.

FOURTH EMBODIMENT

Since the principal components of the fourth embodiment of the invention that embodies the fourth aspect of the invention are similar to those illustrated in FIG. 2, they are indicated and referred to by the identical reference symbols and will not be described any further.

Figure 12:
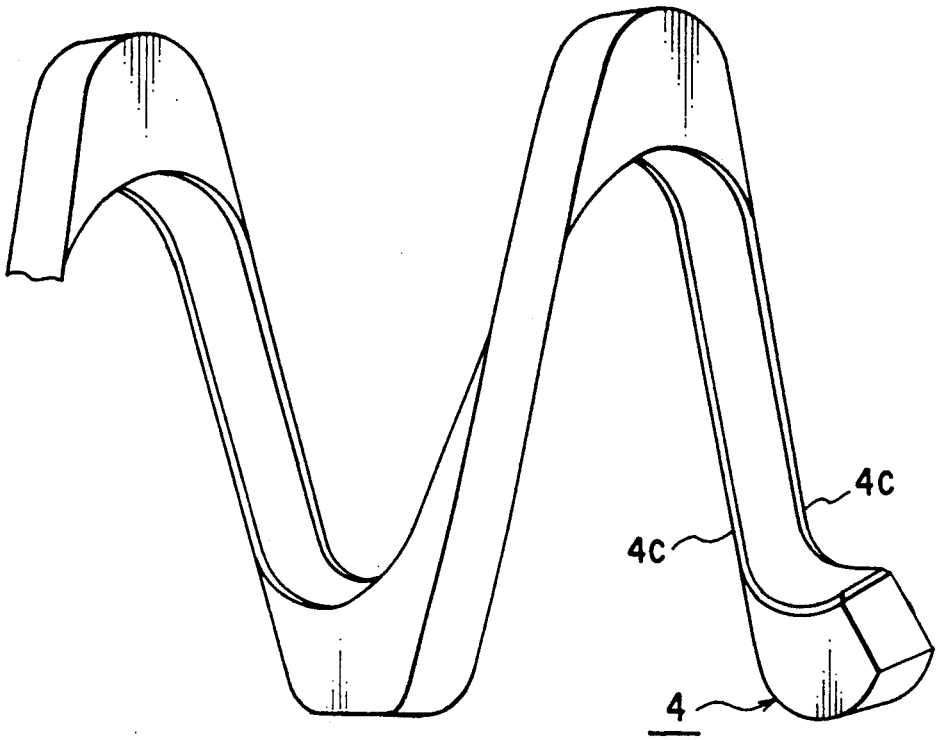
FIG. 12 is a partial perspective view of the blade of an embodiment of the fourth aspect of the invention.
Figure 13:
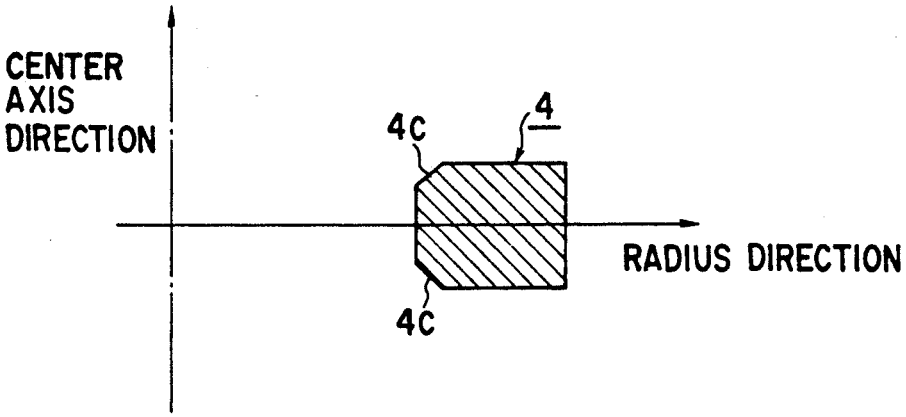
FIG. 13 is a cross sectional view of the blade of FIG. 12.

The primary feature of this fourth embodiment also lies in the sectional view of the blade. As illustrated in FIGS. 12 and 13 which respectively show a partial perspective view and a sectional view of the blade 4 of the embodiment, the blade 4 have "bevels" 4c, 4c along the two inner edges that are closer to the axis of the blade 4 such that the blade has a reduced thickness at the inner periphery. The bevels 4c, 4c can be easily formed without requiring any additional manufacturing step by using a beveled metal mold for injection molding of the blade 4.

Figure 14A:
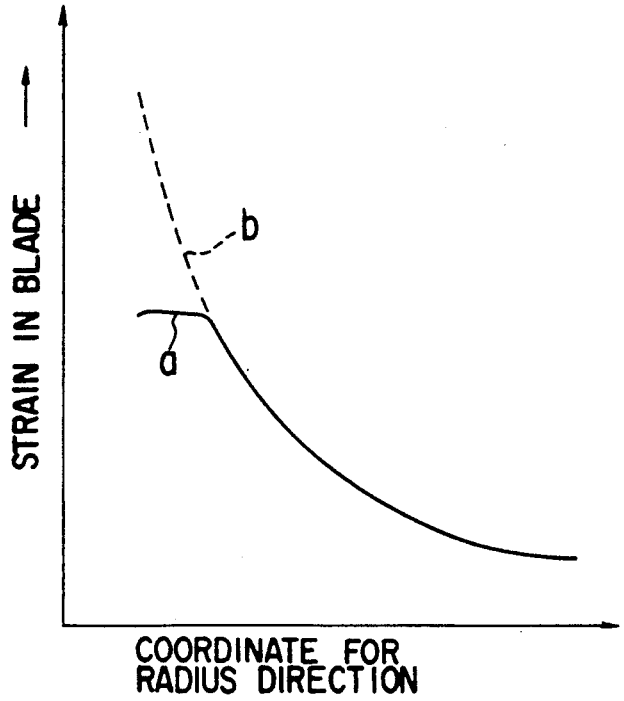
FIGS. 14A and 14B show graphs respectively representing the distribution of strain in the blade of FIG. 12 as viewed in two different directions from the blade illustrated in cross section therebetween.
Figure 14B:
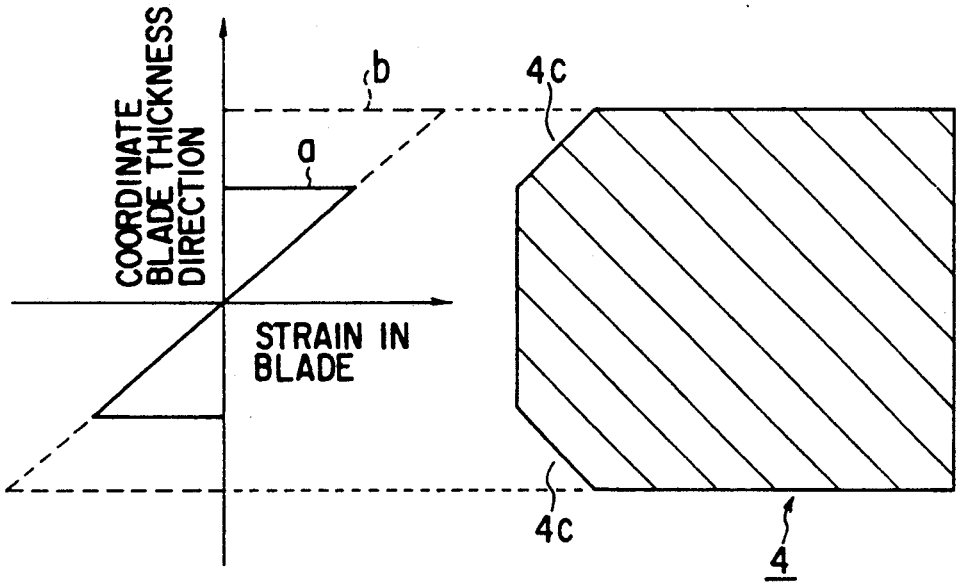

FIGS. 14A and 14B show graphs respectively representing the distributions of strain in the beveled blade illustrated in FIG. 13 as viewed in two different directions, in the direction of the thickness, or perpendicular to the lateral sides, of the inner peripheral surface of the blade 4 and in the radial direction of the blade 4 respectively. Note that, in FIGS. 14A and 14B, the solid lines a show the distribution of strain in the blade 4 the embodiment whereas the broken lines b show that of strain in the blade of a conventional compressor.

Apparently, the level of strain in the direction of the thickness of the inner peripheral surface of the beveled blade 4 of the embodiment as represented by the solid line a of FIG. 14B is by far lower than that of strain of a comparable but not beveled blade 4 as represented by the broken line b of FIG. 14B. Similarly, the level of strain in the radial direction of the beveled blade 4 of the embodiment as represented by the solid line a of FIG. 14A is by far lower than that of strain of a comparable but not beveled blade 4 as represented by the broken line b of FIG. 14A.

It should be noted that the peak level of the peripheral distribution of strain in the blade 4 can be reduced by beveling the blade 4 at and near the spot of the blade 4 corresponding to the junction of two different component curves of the form of the groove of a conventional compressor, if such a groove is used. Then, a blade which is beveled at and near a spot corresponding to the junction of two different component curves of the form of the groove is substantially free from damage and eventual breakage.

Figure 15:
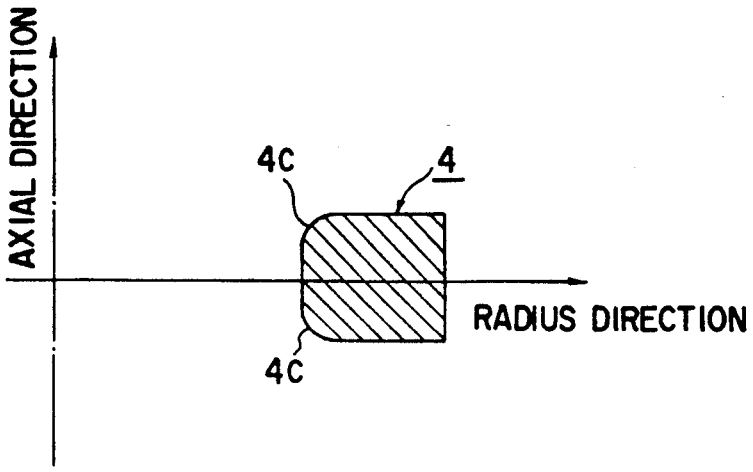
FIG. 15 is a cross sectional view of a blade obtained by modifying the blade of FIG. 12.
Figure 16:
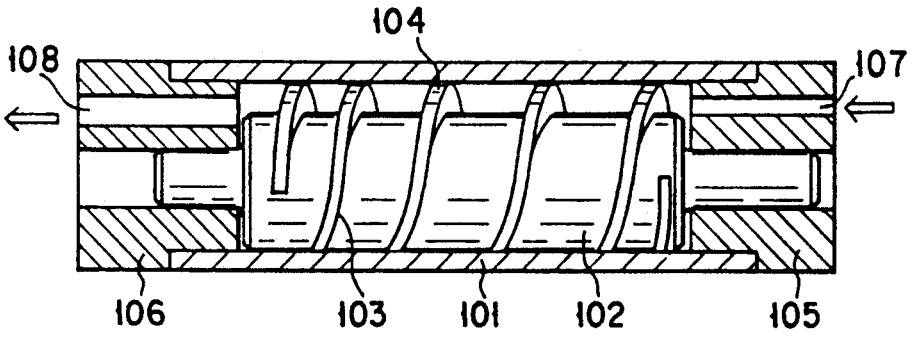
(PRIOR ART) FIG. 16
FIG. 16 is a partial sectional view of a conventional fluid compressor, showing its principal area.

While the blade of the above embodiment is "beveled straight" as shown by the sectional view of the blade in FIG. 13, it may alternatively by "roundly beveled" as illustrated in FIG. 15 without significantly changing the net effect.

A similar effect may be obtained if the blade 4 is beveled not only at and near the spot corresponding to the junction of two component curves of the form of the groove but all the way along the entire inner periphery of the blade. It may be needless to say that such beveling can be adapted to any form of the groove as defined above by referring to the embodiments of the invention to bring forth a similar effect of reducing the level of strain.

ADVANTAGE OF THE INVENTION

As apparent from the above detailed description, a fluid compressor according to the invention can realize a high compression ratio and at the same time reduce the peak level of the strain that can be generated in the blade during the operation of the blade so that the blade is securely protected against damage and eventual breakage due to the strain. Thus, the present invention provides a fluid compressor that operates highly efficiently and, at the same time, very reliably.

While the preparation of a conventional blade requires selection and coordination of a number of parameters to adapt the NC machines involved in the preparation to a combination of a plurality of formulas for various curves, the blade of a fluid compressor according to the invention can be prepared efficiently in a relatively simple process because the blade receiving groove can be expressed by a single formula and therefore involves only a small number of parameters, making the coordination of the parameters relatively easy.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A fluid compressor comprising:

a cylinder provided with a suction port at an axial end thereof and a discharge port at the other axial end thereof;

a turning body rotatably disposed in said cylinder and provided with a helical groove formed on an outer peripheral surface of said cylinder, an axis of said turning body being eccentrically displaced from an axis of said cylinder by a given distance; and a blade held and vertically movable in said groove in a direction of a depth of said groove;

said compressor drawing operating fluid into said cylinder through said suction port, transferring a drawn-in fluid toward a discharge port and eventually discharging the fluid through the discharge port by a rotary movement of said turning body;

wherein said blade is beveled along lateral edges of an inner peripheral surface.

2. A fluid compressor comprising:

a cylinder provided with a suction port at an axial end thereof and a discharge port at the other axial end thereof;

a turning body rotatably disposed in said cylinder and provided with a helical groove formed on an outer peripheral surface of said cylinder, an axis of said turning body being eccentrically displaced from the axis of said cylinder by a given distance;

a blade held and perpendicularly movable in said groove in a direction of a depth of said groove;

said compressor drawing operating fluid into said cylinder through said suction port, transferring a drawn-in fluid toward said discharge port and eventually discharging said fluid through said discharge port by a rotary movement of said turning body;

wherein said helical groove has such a helical form that a strain generated in said blade when said blade is held in contact with and moved relative to said helical groove during an operation of said compressor is kept below a predetermined level; and wherein said helical groove has such a helical form that, when a two-dimensional spread helical groove is expressed by a given formula in terms of a circumferential coordinate and an axial coordinate of said turning body, the values obtained as a result of a second order differentiation of said axial coordinate by a peripheral coordinate in said given formula show an approximately continuous distribution.

3. The compressor according to claim 2, wherein said given formula is such that said values obtained as a result of differentiation of second order of said given formula are less than a predetermined value.

4. The compressor according to claim 2, wherein said given formula consists in expressions in terms of the circumferential coordinate for an abscissa and the axial distance from said suction port for the ordinate of a graph and represents a form convex toward said suction port on a side of said suction port and convex toward said discharge port on a side of said discharge port.

5. The compressor according to claim 2, wherein said blade is made of a fluororesin material.

6. The compressor according to claim 2, wherein said given formula consists in a single relation expressing a relationship between the circumferential coordinate and the axial coordinate of said turning body.

7. The compressor according to claim 2, wherein said blade is beveled along lateral edges of an inner peripheral surface.

8. The fluid compressor of claim 2, wherein said given formula includes an exponential function.

9. The fluid compressor of claim 2, wherein said given formula includes at least one of a power function and an inverse power function.

10. The fluid compressor of claim 2, wherein said given formula includes at least one of a hyperbolic function and an inverse hyperbolic function.

11. The fluid compressor of claim 2, wherein said given formula includes at least one of a trigonometric function and an inverse trigonometric function.

12. A fluid compressor comprising:

a cylinder provided with a suction port at an axial end thereof and a discharge port at the other axial end thereof;

a turning body rotatably disposed in said cylinder and provided with a helical groove formed on an outer peripheral surface of said cylinder, an axis of said turning body being eccentrically displaced from the axis of said cylinder by a given distance;

a blade held and perpendicularly movable in said groove in a direction of a depth of said groove;

said compressor drawing operating fluid into said cylinder through said suction port, transferring a drawn-in fluid toward said discharge port and eventually discharging said fluid through said discharge port by a rotary movement of said turning body;

wherein said helical groove has such a helical form that a strain generated in said blade when said blade is held in contact with and moved relative to said helical groove during an operation of said compressor is kept below a predetermined level;

said given helical form expressed by a formula expressing a given relationship between a circumferential coordinate and an axial coordinate and representing a curved line produced by said helical groove when said turning body is two-dimensionally spread; and wherein said given formula consists in expressions in terms of the circumferential coordinate for an abscissa and the axial distance from the suction port for the ordinate of a graph and represents a form convex toward said suction port on a side of said suction port and convex toward said discharge port on a side of said discharge port.

13. The compressor according to claim 12, wherein said blade is made of a fluororesin material.

14. The compressor according to claim 12, wherein said blade is beveled along lateral edges of an inner peripheral surface.

15. A fluid compressor comprising:

a cylinder provided with a suction port at an axial end thereof and a discharge port at the other axial end thereof;

a turning body rotatably disposed in said cylinder and provided with a helical groove formed on an outer peripheral surface of said cylinder, an axis of said turning body being eccentrically displaced from the axis of said cylinder by a given distance;

a blade held and perpendicularly movable in said groove in a direction of a depth of said groove;

said compressor drawing operating fluid into said cylinder through said suction port, transferring a drawn-in fluid toward said discharge port and eventually discharging said fluid through said discharge port by a rotary movement of said turning body;

wherein said helical groove has such a helical form that a strain generated in said blade when said blade is held in contact with and moved relative to said helical groove during an operation of said compressor is kept below a predetermined level;

wherein said helical groove has such a helical form that, when a two-dimensionally spread helical groove is expressed by a given formula in terms of a circumferential coordinate and an axial coordinate of said turning body, said formula consists in a plurality of relations linked together;

one of said relations expressing a linear relationship between the circumferential coordinate and the axial coordinate, relations linked to opposite ends of at least a part of the linear relation having an inclination equal to that of the linear relation at respective junctions; and wherein said plurality of relations include a relation representing a form convex toward said suction port on the side of said suction port, a relation representing a linear form and a form convex toward said discharge port on the side of said discharge port of said helical groove arranged in the above order from said suction port.

16. The compressor according to claim 15, wherein said relation representing a form convex toward said suction port and said relation representing a form convex toward said discharge port have an inclination equal to that of said relation representing a linear form at the respective junctions.

17. The compressor according to claim 15, wherein said relation representing a form convex toward said suction port and said relation representing a form convex toward said discharge port are rotationally symmetric relative to the relation representing a linear form.

18. The compressor according to claim 15, wherein said blade is made of a fluororesin material.

19. The compressor according to claim 15, wherein when said given formula is expressed in terms of the circumferential coordinate and the axial coordinate of said turning body, the values obtained as a result of differentiation of second order of said axial coordinate by a peripheral coordinate of said given formula show an approximately continuous distribution.

20. The compressor according to claim 15, wherein said blade is beveled along lateral edges of an inner peripheral surface.

21. The fluid compressor of claim 15, wherein said given formula includes an exponential function.

22. The fluid compressor of claim 15, wherein said given formula includes at least one of a power function and an inverse power function.

23. The fluid compressor of claim 15, wherein said given formula includes at least one of a hyperbolic function and an inverse hyperbolic function.

24. The fluid compressor of claim 15, wherein said given formula includes at least one of a trigonometric function and an inverse trigonometric function.

25. A fluid compressor comprising:

a cylinder provided with a suction port at an axial end thereof and a discharge port at the other axial end thereof;

a turning body rotatably disposed in said cylinder and provided with a helical groove formed on an outer peripheral surface of said cylinder, an axis of said turning body being eccentrically displaced from the axis of said cylinder by a given distance;

a blade held and perpendicularly movable in said groove in a direction of a depth of said groove;

said compressor drawing operating fluid into said cylinder through said suction port, transferring a drawn-in fluid toward said discharge port and eventually discharging said fluid through said discharge port by a rotary movement of said turning body;

wherein said helical groove has such a helical form that a strain generated in said blade when said blade is held in contact with and moved relative to said helical groove during an operation of said compressor is kept below a predetermined level;

wherein said given formula is expressed in terms of a circumferential coordinate and an axial coordinate of said turning body, the rate of change of the inclination of the curve expressed by said formula gently changes; and said given formula consists in expression in terms of the circumferential coordinate for an abscissa and an axial distance from said suction port for the ordinate of a graph and represents a form convex toward said suction port on a side of said suction port and convex toward said discharge port on a side of said discharge port.

* * * * *